US006488148B1

(12) United States Patent
Woodson

(10) Patent No.: US 6,488,148 B1
(45) Date of Patent: Dec. 3, 2002

(54) GUN SECURING AND STORAGE DEVICE

(76) Inventor: Lisa M. Woodson, 7973 Bobtail Ct., West Chester, OH (US) 45069

( * ) Notice: Subject to any disclaimer, the term of this patent is extended or adjusted under 35 U.S.C. 154(b) by 0 days.

(21) Appl. No.: 09/917,162

(22) Filed: Jul. 27, 2001

(51) Int. Cl.[7] ..... B65D 85/00
(52) U.S. Cl. ..... 206/317; 206/1.5; 70/63
(58) Field of Search ..... 206/317, 216, 206/223, 576, 579, 580, 372, 373, 1.5, 349; 42/70.07, 70.11; 70/63, 158, 160

(56) References Cited

U.S. PATENT DOCUMENTS

| | | | | |
|---|---|---|---|---|
| D196,842 | S | 11/1963 | Schaefer | |
| 4,084,341 | A | 4/1978 | Cervantes | |
| 5,168,994 | A | * 12/1992 | Beletsky et al. | 206/317 |
| 5,579,909 | A | * 12/1996 | Deal | 206/1.5 |
| 5,621,996 | A | 4/1997 | Mowl, Jr. | |
| 5,647,158 | A | 7/1997 | Eskelinen et al. | |
| 5,680,723 | A | 10/1997 | Ruiz | |
| 5,768,819 | A | 6/1998 | Neal | |
| 5,901,589 | A | * 5/1999 | Cordero | 109/59 R |
| 5,916,087 | A | * 6/1999 | Owens | 224/243 |
| 5,987,941 | A | * 11/1999 | Zocco | 109/59 R |
| 5,996,865 | A | * 12/1999 | Bissey | 206/37 |
| 6,253,915 | B1 | * 7/2001 | Mesica et al. | 206/317 |
| 6,260,300 | B1 | * 7/2001 | Klebes et al. | 206/317 |

* cited by examiner

*Primary Examiner*—Shian Luong

(57) ABSTRACT

A gun securing and storage device for securing a handgun from access and accidental discharge. The gun securing and storage device includes a case having a base portion and a cover portion hingedly coupled together. The base portion includes a bottom panel having a peripheral wall extending upwardly therefrom. The bottom panel has an inner wall and an outer wall such that a chamber is defined between the inner and outer walls. A plurality of aligned holes extends through the inner wall and into the chamber. A locking means is attached to the case for locking the case. A plurality of trigger guard engaging members is positionable within a trigger guard of a handgun. Each of trigger guard engaging members includes a male portion removably coupled to one of the holes, a female portion coupled to the top panel and aligned with one of the holes in the bottom panel.

13 Claims, 7 Drawing Sheets

GUN SECURING AND STORAGE DEVICE

BACKGROUND OF THE INVENTION

1. Field of the Invention

The present invention relates to gun locking devices and more particularly pertains to a new gun securing and storage device for securing a handgun from access and accidental discharge.

2. Description of the Prior Art

The use of gun locking devices is known in the prior art. More specifically, gun locking devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,647,158; U.S. Pat. No. 5,680,726; U.S. Pat. No. 4,083,341; U.S. Pat. No. 5,768,819; U.S. Pat. No. 5,621,996; and U.S. Des. Pat. No. 196,542.

While these devices fulfill their respective, particular objectives and requirements, the aforementioned patents do not disclose a new gun securing and storage device. The inventive device includes a case having a base portion and a cover portion hingedly coupled together. The base portion includes a bottom panel having a peripheral wall extending upwardly therefrom. The bottom panel has an inner wall and an outer wall such that a chamber is defined between the inner and outer walls. A plurality of aligned holes extends through the inner wall and into the chamber. The holes are generally centrally located in the bottom panel. Each of the holes is threaded. A locking means is attached to the case and selectively locks the case in a closed position. A plurality of trigger guard engaging members is positionable within a trigger guard of a handgun. Each of trigger guard engaging members includes a male portion removably coupled to one of the holes, a female portion coupled to the top panel and aligned with one of the holes in the bottom panel.

In these respects, the gun securing and storage device according to the present invention substantially departs from the conventional concepts and designs of the prior art, and in so doing provides an apparatus primarily developed for the purpose of securing a handgun from access and accidental discharge.

SUMMARY OF THE INVENTION

In view of the foregoing disadvantages inherent in the known types of gun locking devices now present in the prior art, the present invention provides a new gun securing and storage device construction wherein the same can be utilized for securing a handgun from access and accidental discharge.

The general purpose of the present invention, which will be described subsequently in greater detail, is to provide a new gun securing and storage device apparatus and method which has many of the advantages of the gun locking devices mentioned heretofore and many novel features that result in a new gun securing and storage device which is not anticipated, rendered obvious, suggested, or even implied by any of the prior art gun locking devices, either alone or in any combination thereof.

To attain this, the present invention generally comprises a case having a base portion and a cover portion hingedly coupled together. The base portion includes a bottom panel having a peripheral wall extending upwardly therefrom. The bottom panel has an inner wall and an outer wall such that a chamber is defined between the inner and outer walls. A plurality of aligned holes extends through the inner wall and into the chamber. The holes are generally centrally located in the bottom panel. Each of the holes is threaded. A locking means is attached to the case and selectively locks the case in a closed position. A plurality of trigger guard engaging members is positionable within a trigger guard of a handgun. Each of trigger guard engaging members includes a male portion removably coupled to one of the holes, a female portion coupled to the top panel and aligned with one of the holes in the bottom panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gun securing and storage device apparatus and method which has many of the advantages of the gun locking devices mentioned heretofore and many novel features that result in a new gun securing and storage device which is not anticipated, rendered obvious, suggested, or even implied by any of the prior art gun locking devices, either alone or in any combination thereof.

It is another object of the present invention to provide a new gun securing and storage device which may be easily and efficiently manufactured and marketed.

It is a further object of the present invention to provide a new gun securing and storage device which is of a durable and reliable construction.

An even further object of the present invention is to provide a new gun securing and storage device which is susceptible of a low cost of manufacture with regard to both materials and labor, and which accordingly is then susceptible of low prices of sale to the consuming public, thereby making such gun securing and storage device economically available to the buying public.

Still yet another object of the present invention is to provide a new gun securing and storage device which provides in the apparatuses and methods of the prior art some of the advantages thereof, while simultaneously overcoming some of the disadvantages normally associated therewith.

Still another object of the present invention is to provide a new gun securing and storage device for securing a handgun from access and accidental discharge.

Yet another object of the present invention is to provide a new gun securing and storage device which includes a case having a base portion and a cover portion hingedly coupled together. The base portion includes a bottom panel having a peripheral wall extending upwardly therefrom. The bottom panel has an inner wall and an outer wall such that a chamber is defined between the inner and outer walls. A plurality of aligned holes extends through the inner wall and into the chamber. The holes are generally centrally located in the bottom panel. Each of the holes is threaded. A locking means is attached to the case and selectively locks the case in a closed position. A plurality of trigger guard engaging members is positionable within a trigger guard of a handgun. Each of trigger guard engaging members includes a male portion removably coupled to one of the holes, a female portion coupled to the top panel and aligned with one of the holes in the bottom panel.

Still yet another object of the present invention is to provide a new gun securing and storage device that has adjustable securing devices for holding multiple types of handguns.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
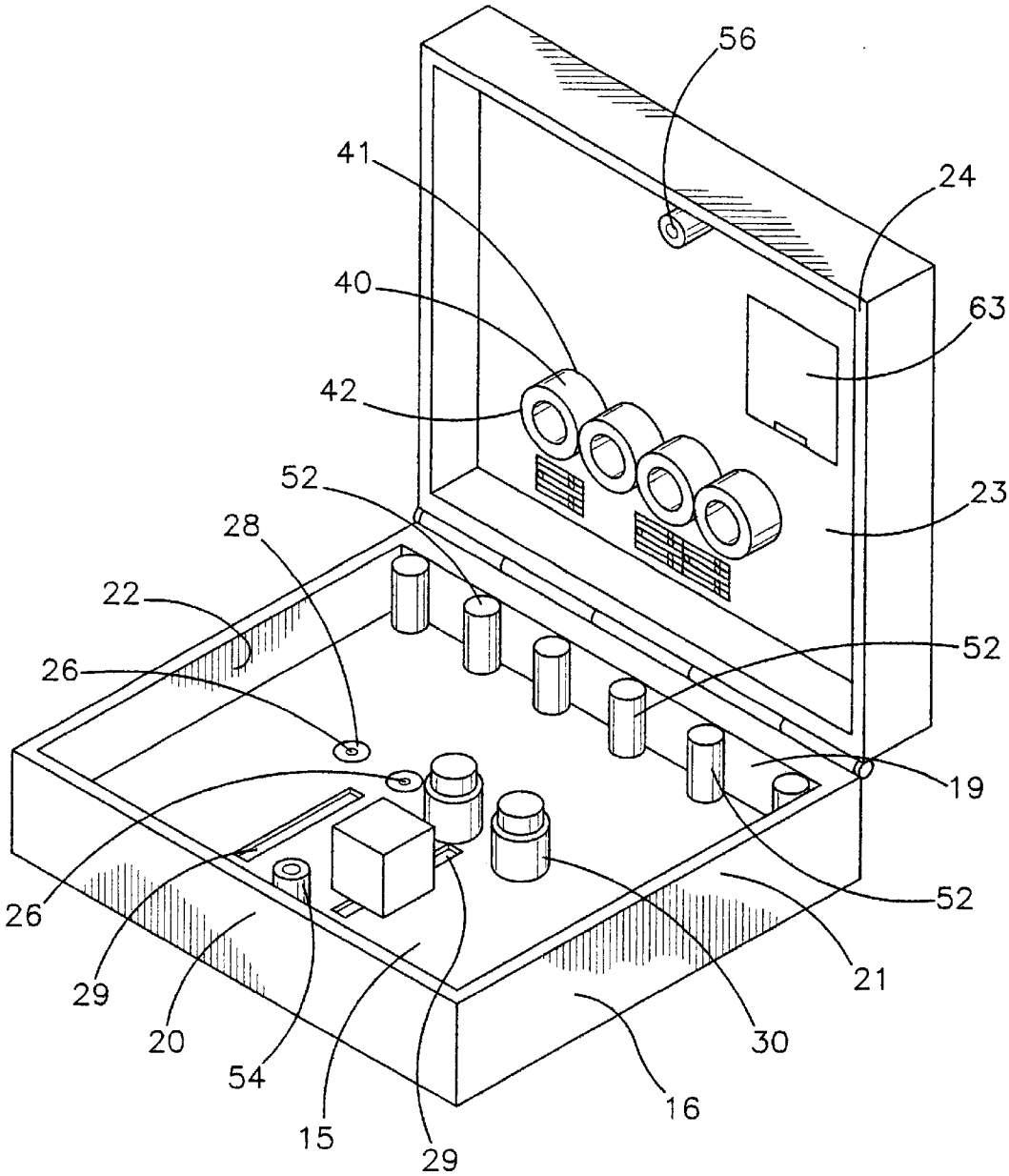
FIG. 1 is a schematic perspective view of a new gun securing and storage device according to the present invention.

With reference now to the drawings, and in particular to FIGS. 1 through 7 thereof, a new gun securing and storage device embodying the principles and concepts of the present invention and generally designated by the reference numeral 10 will be described.

As best illustrated in FIGS. 1 through 7, the gun securing and storage device 10 generally comprises a device for holding a conventional handgun 5 having a barrel portion 6, a handgrip 7, a trigger 8 and a trigger guard 9 extending from the barrel 6 to the handgrip 7 and around the trigger 8. The device 10 includes a case 12 having a base portion 13 and a cover portion 14 hingedly coupled together. The base portion 13 includes a bottom panel 15 having a peripheral wall 16 extending upwardly therefrom. The bottom panel 15 has an inner wall 17 and an outer wall 18 such that a chamber 27 is defined between the inner 17 and outer 18 walls. The peripheral wall 16 includes a back wall 19, a front wall 20, a first side wall 21 and second side wall 22. The cover portion 14 includes a top panel 23 having perimeter wall 24 extending downwardly therefrom. A plurality of hinges 25 hingedly couples the perimeter wall 24 to the back wall 19 such that the cover 14 and base 13 portions may selectively be moved between an open position and a closed position. The case 12 comprises a substantially rigid material. A plurality of aligned holes 26 extends through the inner wall 17 and into the chamber 27. The holes 26 are generally centrally located in the bottom panel 15 and extend along a line orientated perpendicular to the first 21 and second 22 side walls. The plurality of holes 26 is preferably four holes. Each of the holes 26 is threaded and bounded by one of a plurality of annular depressions 28 extending into the inner wall 17. A pair of elongated slots 29 extends through the inner wall 17 into the chamber 27. Each of the slots 29 are orientated parallel to the side walls 21, 22. The slots 29 are positioned between the holes 26 and the front wall 20 and extend generally to the holes 26. A first of the slots 29 is generally positioned between a first pair of holes and a second of the slots is generally positioned between a second pair of holes.

A plurality of trigger guard engaging members is positionable within the trigger guard 9 of the gun 6 when the gun 6 is placed in the case 12. Each of trigger guard engaging members includes a male portion 30 and a female portion 40.

Figure 2:
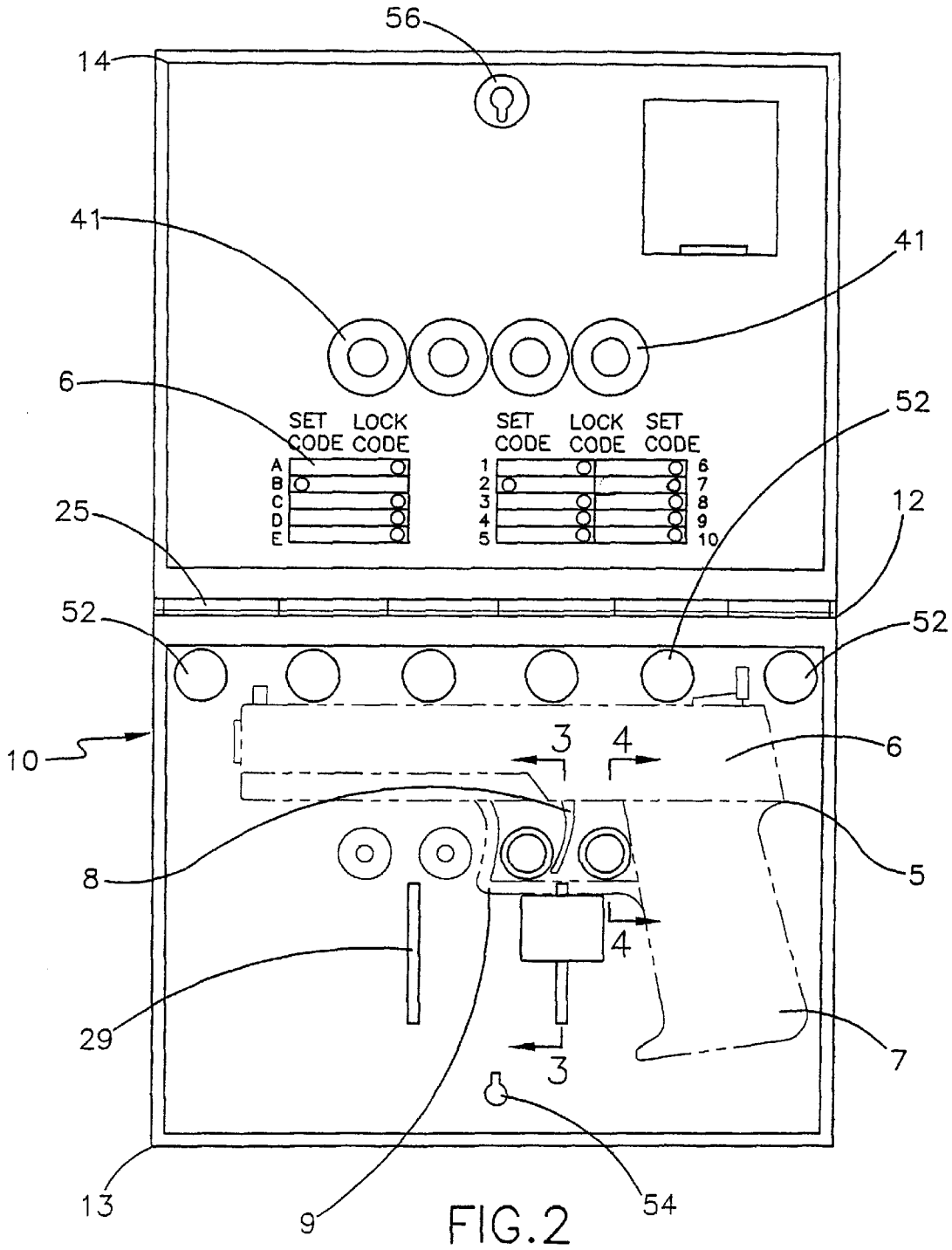
FIG. 2 is a schematic plan view of the present invention.
Figure 3:
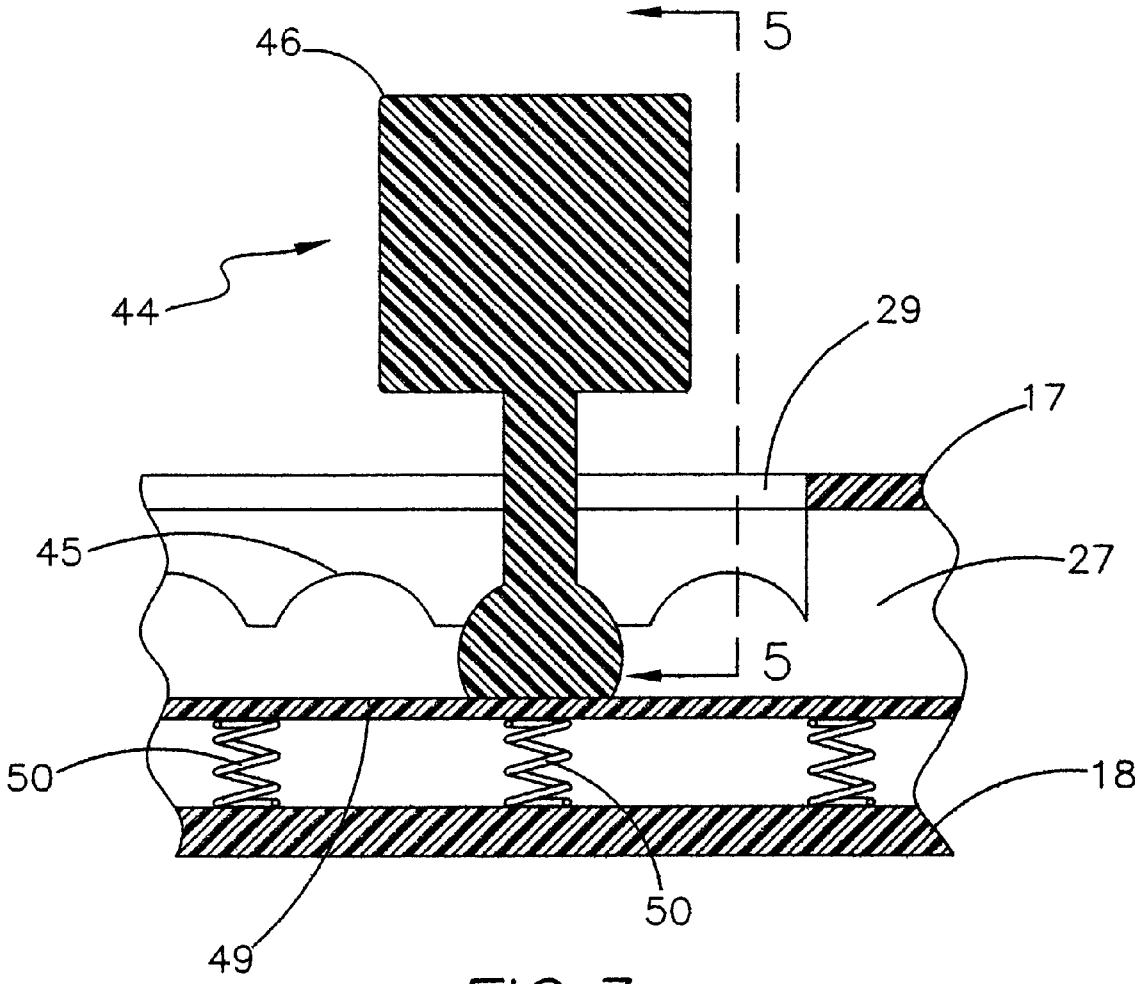
FIG. 3 is a schematic cross-sectional view taken along line 3–3 of FIG. 2 of the present invention.
Figure 4:
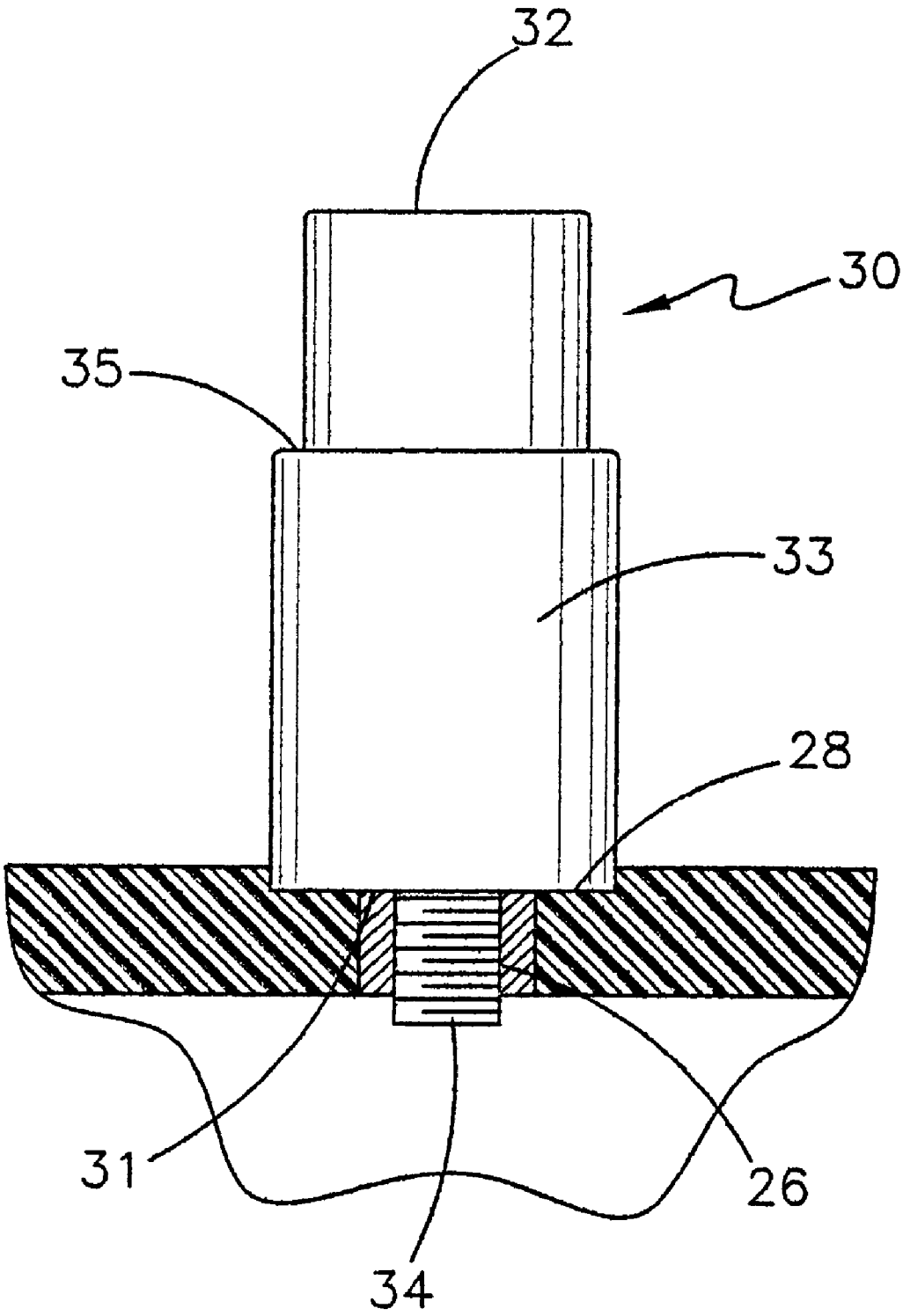
FIG. 4 is a schematic cross-sectional view taken along 4–4 of FIG. 2 of the present invention.
Figure 5:
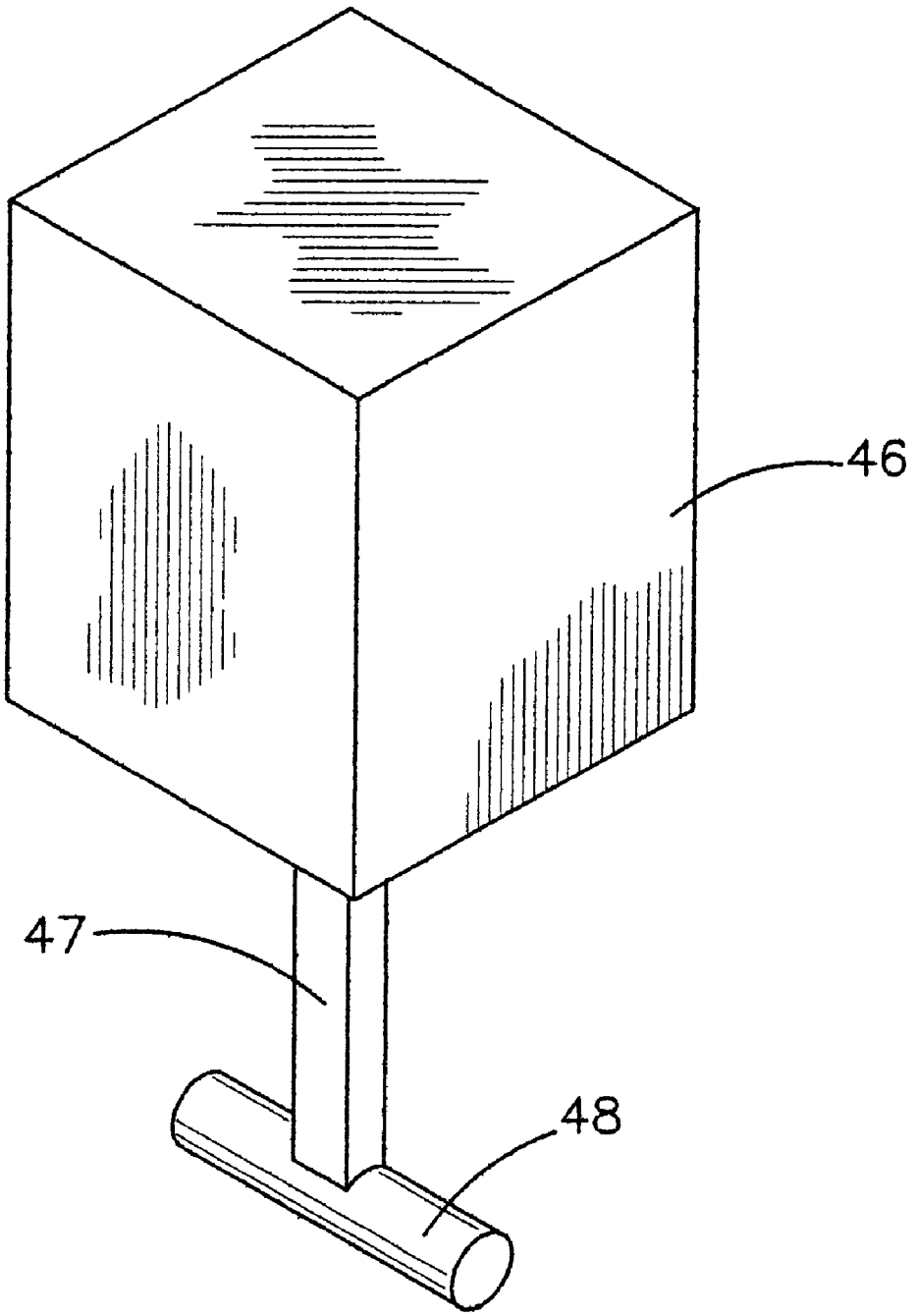
FIG. 5 is a schematic perspective view stabilizing member of the present invention.
Figure 6:
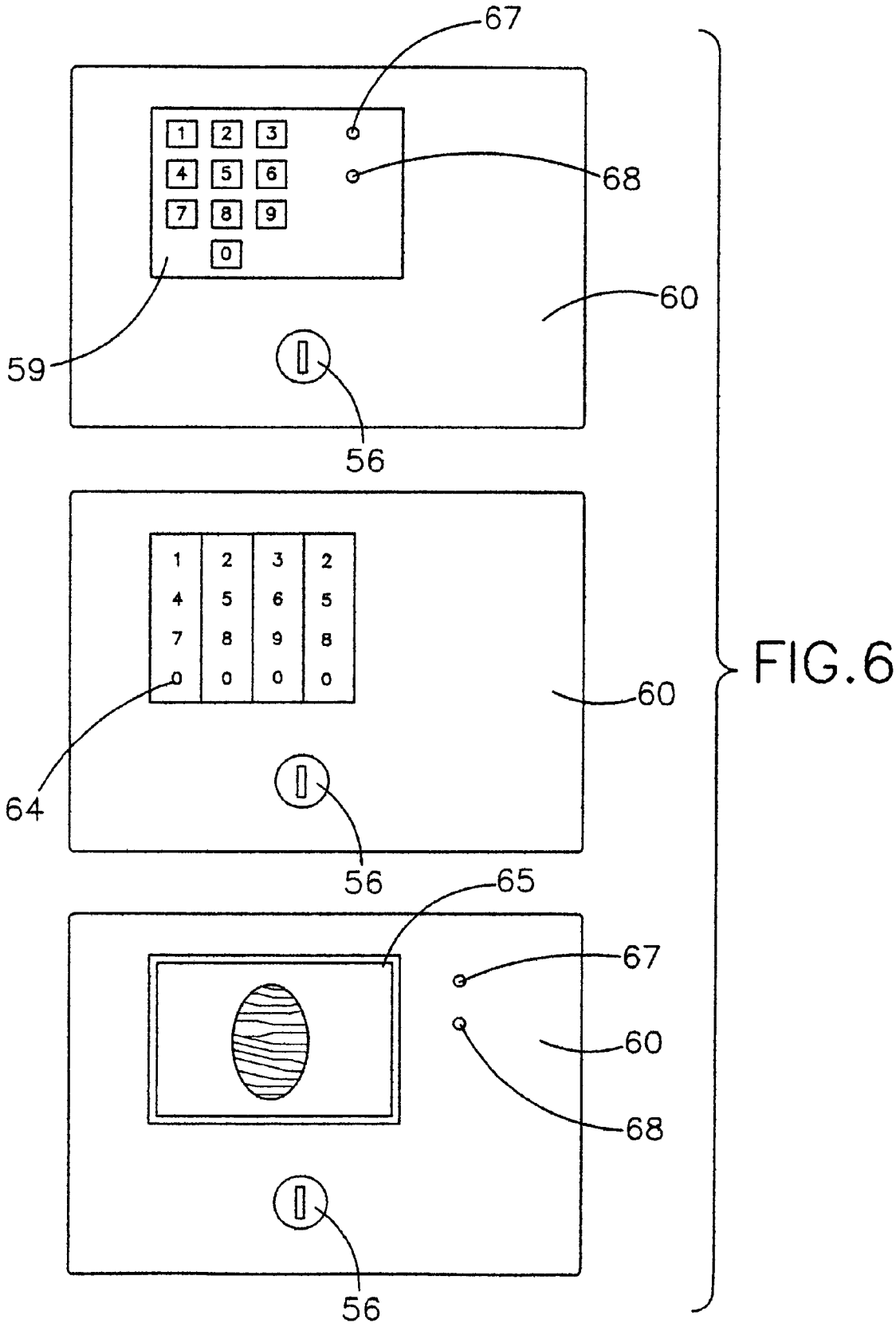
FIG. 6 is a schematic plan view of the locking means of the present invention.
Figure 7:
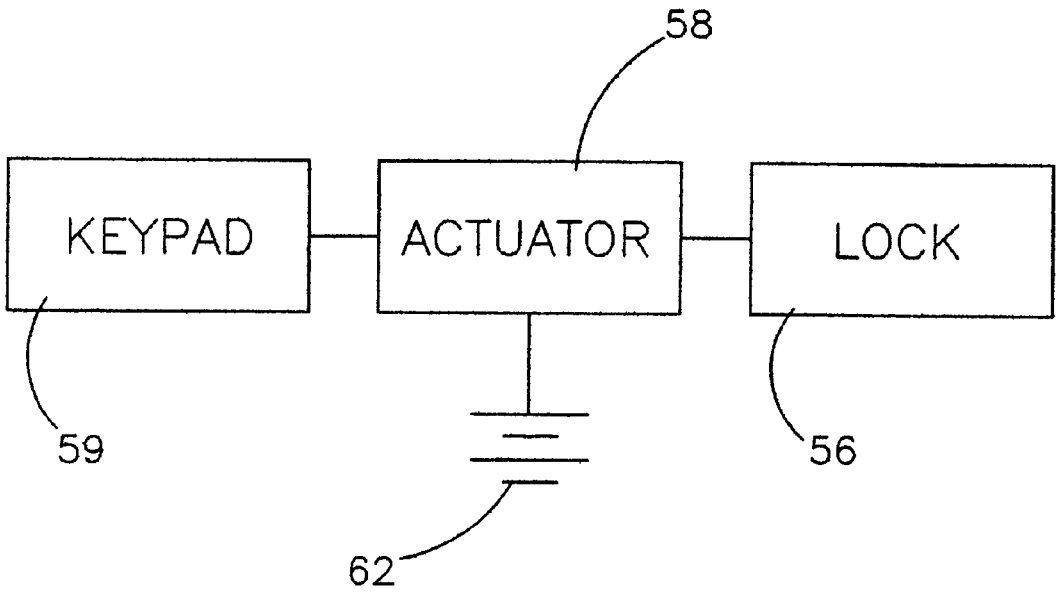
FIG. 7 is a schematic view of the present invention.

The male portions 30 have a first end 31, a second end 32 and a peripheral wall 33 extending therebetween. A threaded rod 34 is attached to and extends away from the first end 32 of the male portion 30. The rod 34 is selectively positioned in and threadably coupled to one of the holes 26. The first end 31 has a diameter generally equal to a diameter of the depression 28 such that the male portion 30 sits in the depression. The holes 26 chosen for insertion of one of the male portions 30 depends on the gun 6 and where they are needed such that two of the male portions 30 are positionable in the trigger guard 9 as shown in FIG. 2. The peripheral wall 33 of the male portion 30 has a shoulder 35 therein positioned generally between the first 31 and second ends 32.

The female portions 40 comprise a cylinder having a first end 41 attached to the top panel 23 and a second end 42 extending away from the top panel 23 and toward the bottom panel 15 when the case 12 in the closed position. Each of the female portions 40 are aligned with one of the holes 26 in the bottom panel 15. The female portions 40 are abuttable against the shoulder 35 when the male portion 30 is positioned in one of the associated and aligned hole.

A stabilizing member 44 biases the trigger guard 9 against the trigger guard engaging members. The stabilizing member 44 includes the inner wall 17 having an inside surface within the chamber 27 having a plurality of notches 45 therein positioned along a length of the slots 29. A block 46 has a post 47 attached thereto and extends away therefrom. The post 47 is extendable into one of the slots 29 such that the block 46 is movable along the slots. A bulbous member 48 is attached to a free end of the post 47. The bulbous member 48 has a width less than a width of the slot and a length greater than a width of the slot. The bulbous member 48 may be turned in a first position for engaging the notches 45 and a second position for extending the bulbous member through the slot 29. This allows the user to determine which slot 29 they the block 46 will be coupled to. The block 46 is abuttable against the trigger guard 9. A biasing means biases the bulbous member 48 against one of the notches 45. The biasing means comprises a plate 49 positioned in the chamber 27 and below the slots 29. A plurality of biasing members 50 biases the plate 49 away from the outer wall 18 and toward the inner wall 17. Each of the biasing members 50 comprises a spring. The block 46 is placed against the trigger guard 9 as shown in FIG. 2 and allowed to frictionally engage one of the notches 45.

A cushioning means 52 cushions the gun 6 in the case 12. The cushioning means 52 is attached to the bottom panel 15 and positioned generally adjacent to the back wall 19. The cushioning means 52 comprises a resiliently flexible material.

A locking means selectively locks the case 12 in the closed position. The locking means includes a male coupler 54 attached to the bottom panel 15 and a female coupler 56 attached to the top panel 23. The male coupler 54 is extendable in the female coupler 56 when the case 12 in the closed position. The female coupler 56 comprises a lock. An electric actuator 58 is mechanically coupled to the lock 56 for selectively locking and unlocking the lock 56. A keypad 59 is operationally coupled to the actuator 58 for entering a combination code. The keypad 59 has is mounted to an outer surface 60 of the top panel 23. A plurality of switches 61 is operationally coupled to the lock 56 for determining the combination code. A power supply 62 comprising a battery is operationally coupled to the actuator 58. The power supply 62 is removably mounted in the top panel 23, and a door 63 is positioned in the top panel 23 for removing the battery. Alternatively, a combination wheel-type lock 64 may be used, or a conventional lock using a key. Also envisioned is a touch pad 65 for scanning a finger print and opening said lock via said actuator if there is a finger print match, though any conventional lock may be utilized. Ideally, a first indication light 67 indicates the device is locked and a second indication light 68 the device is unlocked. Ideally, the second indication light 68 flashes when battery power is low. Other envisioned locking devices include a digital key pad, a voice recognition system and a retina identification scanner, each of which is known in the art.

In use, the handgun 6 is positioned in the case 12. The male portions 30 being moved to positions so that they may extend through the trigger guard 9 when gun is within the case. The stabilizing member 44 may be positioned in the adequate slot 29 and abutted against the trigger guard 9 for holding the gun 6 in a generally secure position. The female portions 41 receive the male portions to further secure the handgun 6 in position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. The gun case device for holding a handgun having a barrel portion, a handgrip, a trigger and a trigger guard extending from the barrel to the handgrip and around the trigger, said device comprising:

a case having a base portion and a cover portion hingedly coupled together, said base portion including a bottom panel having a peripheral wall extending upwardly therefrom, said bottom panel having an inner wall and an outer wall such that a chamber is defined between said inner and outer walls, a plurality of aligned holes extending through said inner wall and into said chamber, said holes being generally centrally located in said bottom panel, each of said holes being threaded, a locking means being attached to said case and selectively locking said case in a closed position;

a plurality of trigger guard engaging members for positioning within the trigger guard of the gun, each of trigger guard engaging members including;

a male portion being removably coupled to one of said holes; and a female portion being coupled to said top panel and being aligned with one of said holes in said bottom panel.

2. The gun case device as in claim 1, wherein said peripheral wall of said base portion including a back wall, a front wall, a first side wall and second side wall, said cover portion including a top panel having perimeter wall extending downwardly therefrom, a plurality of hinges hingedly coupled said perimeter wall to said back wall such that said cover and base portions may selectively be moved between an open position and a closed position.

3. The gun case device as in claim 2, wherein said holes are generally centrally located in said bottom panel and extending along a line orientated perpendicular to said first and second side walls.

4. The gun case device as in claim 1, further including a pair of elongated slots extending through said inner wall and into said chamber, said slots being positioned between said holes and said peripheral wall and extending between said peripheral wall and said holes; and a stabilizing member for biasing the trigger guard against said trigger guard engaging members, said stabilizing member being extendably in one of said slots and being abuttable against the trigger guard.

5. The gun case device as in claim 4, wherein said stabilizing member further includes:

said inner wall having an inside surface in said chamber having a plurality of notches therein positioned along a length of said slots;

a block having a post attached thereto and extending away therefrom, said post being extendable into one of said slots such that said block is movable along said slots, a bulbous member attached to a free end of said post, said bulbous member having a width less than a width of said slot and a length greater than a width of said slot, wherein said bulbous member may be turned in a first position for engaging said notches and a second position for extending said bulbous member through said slot; and a biasing means for biasing said bulbous member against one of said notches.

6. The gun case device as in claim 5, wherein said biasing, means comprises:

a plate being, positioned in said chamber and below said slots; and a plurality of biasing members biasing said plate away from said outer wall and toward said inner wall, each of said biasing members comprising a spring.

7. The gun case device as in claim 4, further including:

a cushioning means for cushioning the gun in said case, said cushioning means being attached to said bottom panel and positioned generally against said peripheral wall such that said holes are between said slots and said cushioning means, said cushioning means comprising a resiliently flexible material.

8. The gun case device as in claim 1, wherein said male portion has a first end, a second end and a peripheral wall extending therebetween, a threaded rod being attached to and extending away from said first end of said male portion, said rod being selectively positioned in and threadably coupled to one of said holes.

9. The gun case device as in claim 8, wherein said device further comprises:

each of said holes being bounded by one of a plurality of annular depressions extending into said inner wall; and said first end having a diameter generally equal to a diameter of said depression.

10. The gun case device as in claim 8, wherein said device further comprises:

said peripheral wall of said male portion having a shoulder therein positioned generally between said first and second ends; and said female portion comprising a cylinder having a first end attached to said top panel and a second end extending away from said top panel and extending toward said bottom panel when said case in said closed position, said female portion being aligned with one of said holes in said bottom panel, wherein said female portion is abuttable against said shoulder when said male portion is positioned in the aligned hole.

11. The gun case device as in claim 1, wherein said locking means includes a male coupler attached to said bottom panel and a female coupler attached to said top panel, said male coupler being extendable in said female coupler when said case in said closed position, said female coupler comprising a lock, said lock being a combination lock.

12. The gun case device as in claim 1, wherein said locking means includes a male coupler attached to said bottom panel and a female coupler attached to said top panel, said male coupler being extendable in said female coupler when said case in said closed position, said female coupler comprising a lock, an electric actuator being mechanically coupled to said lock for selectively locking and unlocking said lock, a keypad being operationally coupled to said actuator for entering a combination code, said keypad having being mounted to an outer surface of said top panel, a power supply being operationally coupled to said actuator, said power supply comprising a battery and being removably mounted in said top panel, a door being positioned in said top panel for removing said battery.

13. A gun case device for holding a handgun having a barrel portion, a handgrip, a trigger and a trigger guard extending from the barrel to the handgrip and around the trigger, said device comprising:

a case having a base portion and a cover portion hingedly coupled together, said base portion including a bottom panel having a peripheral wall extending upwardly therefrom, said bottom panel having an inner wall and an outer wall such that a chamber is defined between said inner and outer walls, said peripheral wall including a back wall, a front wall, a first side wall and second side wall, said cover portion including a top panel having perimeter wall extending downwardly therefrom, a plurality of hinges hingedly coupled said perimeter wall to said back wall such that said cover and base portions may selectively be moved between an open position and a closed position, said case comprising a substantially rigid material, a plurality of aligned holes extending through said inner wall and into said chamber, said holes being generally centrally located in said bottom panel and extending along a line orientated perpendicular to said first and second side walls, said plurality of holes being four holes, each of said holes being threaded, each of said holes being bounded by one of a plurality of annular depressions extending into said inner wall, a pair of elongated slots extending through said inner wall and into said chamber, each of said slots being orientated parallel to said side walls, said slots being positioned between said holes and said front wall and extending generally to said holes, a first of said slots being generally positioned between a first pair of holes and a second of said slots being generally positioned between a second pair of holes;

a plurality of trigger guard engaging members for positioning within the trigger guard of the gun, each of trigger guard engaging members including;

a male portion having a first end, a second end and a peripheral wall extending therebetween, a threaded rod being attached to and extending away from said first end of said male portion, said rod being selectively positioned in and threadably coupled to one of said holes, said first end having a diameter generally equal to a diameter of said depression, said peripheral wall of said male portion having a shoulder therein positioned generally between said first and second ends;

a female portion comprising a cylinder having a first end attached to said top panel and a second end extending away from said top panel and extending toward said bottom panel when said case in said closed position, said female portion being aligned with one of said holes in said bottom panel, wherein said female portion is abuttable against said shoulder when said male portion is positioned in the aligned hole;

wherein a pair of male portions are coupled to a pair of adjacent holes such that said male portions are positioned in the trigger guard when the handgun is positioned in the case;

a stabilizing member for biasing said trigger guard against said trigger guard engaging members, said stabilizing member comprising;

said inner wall having an inside surface in said chamber having a plurality of notches therein positioned along a length of said slots;

a block having a post attached thereto and extending away therefrom, said post being extendable into one of said slots such that said block is movable along said slots, a bulbous member attached to a free end of said post, said bulbous member having a width less than a width of said slot and a length greater than a width of said slot, wherein said bulbous member may be turned in a first position for engaging said notches and a second position for extending said bulbous member through said slot, said block being abuttable against said trigger guard;

a biasing means for biasing said bulbous member against one of said notches, said biasing means comprising;

a plate being positioned in said chamber and below said slots;

a plurality of biasing members biasing said plate away from said outer wall and toward said inner wall, each of said biasing members comprising a spring;

a cushioning means for cushioning the gun in said case, said cushioning means being attached to said bottom panel and positioned generally adjacent to said back wall, said cushioning means comprising a resiliently flexible material; and a locking means for selectively locking said case in said closed position, said locking means including a male coupler attached to said bottom panel and a female coupler attached to said top panel, said male coupler being extendable in said female coupler when said case in said closed position, said female coupler comprising a lock, an electric actuator being mechanically coupled to said lock for selectively locking and unlocking said lock, a keypad being operationally coupled to said actuator for entering a combination code, said keypad having being mounted to an outer surface of said top panel, a power supply being operationally coupled to said actuator, said power supply comprising a battery and being removably mounted in said top panel, a door being positioned in said top panel for removing said battery.

* * * * *